United States Patent [19]

Chiba et al.

[11] Patent Number: 4,793,733

[45] Date of Patent: Dec. 27, 1988

[54] SCARIFIER

[75] Inventors: Tatsuhiko Chiba, Kawaguchi; Ken-ichi Igarashi, Kohnosu, both of Japan

[73] Assignee: Taisei Road Construction Co., Ltd., Tokyo, Japan

[21] Appl. No.: 70,722

[22] Filed: Jul. 7, 1987

[30] Foreign Application Priority Data

Dec. 3, 1986 [JP] Japan ..... 61-186417[U]

[51] Int. Cl.[4] ..... E01C 23/12

[52] U.S. Cl. ..... 404/90; 404/96; 299/36; 172/196; 172/471; 172/488; 172/501; 172/699

[58] Field of Search ..... 404/90, 91, 96; 299/36, 299/37; 37/108 R, 108 A; 172/196, 199, 200, 464, 468, 470, 471, 476, 483, 488, 501, 645, 646, 655, 656, 661, 699

[56] References Cited

U.S. PATENT DOCUMENTS

| | | | |
|---|---|---|---|
| 2,042,196 | 5/1936 | Senz | 404/90 X |
| 2,279,869 | 4/1942 | Houston | 299/36 X |
| 2,700,833 | 2/1955 | Small | 299/36 X |
| 3,754,791 | 8/1973 | Hoermann | 299/36 |
| 3,989,401 | 11/1976 | Moench | 404/90 X |
| 4,129,398 | 12/1978 | Schoelkopf | 404/90 X |
| 4,252,198 | 2/1981 | Formhals | 172/501 X |
| 4,625,809 | 12/1986 | Moynihan | 172/196 X |

FOREIGN PATENT DOCUMENTS

| | | | |
|---|---|---|---|
| 3508884 | 9/1986 | Fed. Rep. of Germany | 404/90 |

*Primary Examiner*—Jerome W. Massie
*Assistant Examiner*—John F. Letchford
*Attorney, Agent, or Firm*—Cushman, Darby & Cushman

[57] ABSTRACT

A scarifier suspended beneath the body of an automotive vehicle such that it is vertically movable by means of cylinders. It comprises a suspending frame provided on a main frame vertically movable by means of the cylinders so that it may be freely slidable in the widthwise direction of the vehicle body, a plurality of supporting bars horizontally disposed within the suspending frame so that they may extend in the longitudinal direction of the suspending frame and so that any two adjacent bars may be connected in series to each other by means of a pin, said supporting bars being each connected to a cylinder vertically provided on the suspending frame so that each bar may be inclined in the longitudinal direction, and a multiplicity of claws provided, at prescribed intervals, on the supporting bars by way of pins in such a manner that they extend downwards from the pins and that they are swingable about the pins.

2 Claims, 5 Drawing Sheets

SCARIFIER

BACKGROUND OF THE INVENTION

1. FIELD OF THE INVENTION

The present invention relates to a scarifier and, more particularly, to a scarifier whose supporting bars for claws can have their ends vertically moved so as to permit tip ends of the claws to easily follow up the irregularities of a road surface for scarifying the same to a uniform depth.

2. DESCRIPTION OF THE PRIOR ART

Conventionally, a scarifier is disposed beneath a road processing vehicle. In such a road surface layer reproducing vehicle A as shown in FIG. 6, the scarifier 1 is disposed beneath a vehicle body B and at the back of front wheels C. This scarifier 1, generally, has a suspending frame which is slender widthwise of the vehicle body when viewed from above and which can be freely raised or lowered. The suspending frame is provided with a plurality of supporting bars in such a manner that they are arranged in series in the longitudinal direction of the suspending frame. Each supporting bar has a plurality of claws fixed thereto in such a manner that they extend vertically downwardly from the supporting bar, and each supporting bar can be vertically moved while being maintained in its posture in which it is laid horizontally.

In the above-mentioned prior art scarifier, the tip end portions of the claws can be pierced into the surface layer of a road, or can be upwardly drawn off from the road surface, by vertically moving the suspending frame. That is, the tip end portions of the claws F are caused to follow up the concavities and convexities of the road surface layer G by vertically moving the supporting bar. As shown in FIG. 7 showing its front view, each supporting bar E is vertically moved while being kept in its horizontally laid posture. In addition, each claw F is fixed t the supporting bar E at right angles thereto. For these reasons, when the claw end is pierced into the road surface layer G, some claw ends H are pierced deeply while other J are pierced only to a small depth. As a result, the surface layer fails to be scarified to a uniform depth. The concavities and convexities of the road surface layer G are created by, for example, rutting. This demands an improved fluidity of an asphalt mixture constituting the road surface layer. However, repairing of the road surface layer would be much less effective unless it is performed after the layer has been scarified to a uniform depth.

SUMMARY OF THE INVENTION

The present invention has been developed in order to solve the above-mentioned problems inherent in the prior art and its object is to provide a scarifier having a structure wherein the claws are capable of readily following up the concavities and convexities, as well, of the road surface layer.

To attain the above object, according to one aspect of the present invention, there is provided a scarifier suspended beneath a body of automotive vehicle such that it is vertically movable by means of cylinders, which comprises a suspending frame provided on a main frame vertically movable by means of the cylinders so that it may be freely slidable in the widthwise direction of the vehicle body, a plurality of supporting bars horizontally disposed within the suspending frame so that they may extend in the longitudinal direction of the suspending frame and so that any two adjacent bars may be connected in series to each other by means of a pin, said supporting bars being each connected t a cylinder vertically provided on the suspending frame so that each bar may be inclined in the longitudinal direction, and a multiplicity of claws provided, at prescribed intervals, on the supporting bars by way of pins in such a manner that they extend vertically downwardly from the pins and that they are swingable about the pins.

According to another aspect of the present invention, there is provided a scarifier wherein the claw is formed at its head portion with a through bore which extend laterally as viewed from the front side of the claw, said through bore being fitted with a bearing outer ring which is rotatably fitted with an inner race, said inner race being formed with a pin hole extending laterally therethrough, said pin hole having an inner diameter larger than the outer diameter of the pin of a fitting.

In the present invention, when the main frame is disposed beneath the body of, for example, a road surface layer reproducing vehicle in a manner that it is vertically movable by means of cylinders, the suspending frame provided to the main frame can also be vertically moved. That is, by upwardly moving the suspending frame, the claws provided on the same are upwardly drawn off from the road surface and are thereby prevented from hindering the running of the vehicle body. When the main frame is lowered by means of the cylinders for starting the repairing operation, the suspending frame is also lowered, so that the tip ends of the claws on the suspending frame are brought into contact with the road surface. When the cylinders are further operated so as to cause their rods to extend downwards, the tip or lower ends of the claws are pierced into the road surface layer. Thus, if the vehicle body were advanced in a state wherein the lower end of each claw is thrusted, for example, 5 cm, the road surface layer will be scarified to the depth of 5 cm.

Where the road surface to be repaired has concavities and convexities attributable to rutting and the like, the cylinders disposed within the suspending frame are operated to cause the supporting bars to be so inclined as to be in conformity with such irregularities of the road surface. That is, when viewed from a front side of the vehicle body, the supporting bars are vertically moved at one end and thus inclined from right toward left or vice versa in such a manner as to follow up such irregularities. As a result, each claw which is swingably suspended, via the pin, from the inclined supporting bar becomes perpendicular to the road surface, so that the lower ends of the claw come close thereto with an equal distance left from the road surface, i.e., in a state wherein they follow up the irregular surface of the repairing road. Subsequent lowering of the main frame to pierce the claw ends into the road surface layer, therefore, makes it possible for them to scarify the irregular surface layer to a substantially uniform depth when the vehicle body is advanced

BRIEF DESCRIPTION OF THE DRAWINGS

An embodiment of the invention is shown in FIGS. 1 to 6,

FIG. 6 of which is a side view of a road surface layer reproducing vehicle, showing a state wherein the scarifier is mounted therein, while

DESCRIPTION OF THE PREFERRED EMBODIMENT

Figure 1:
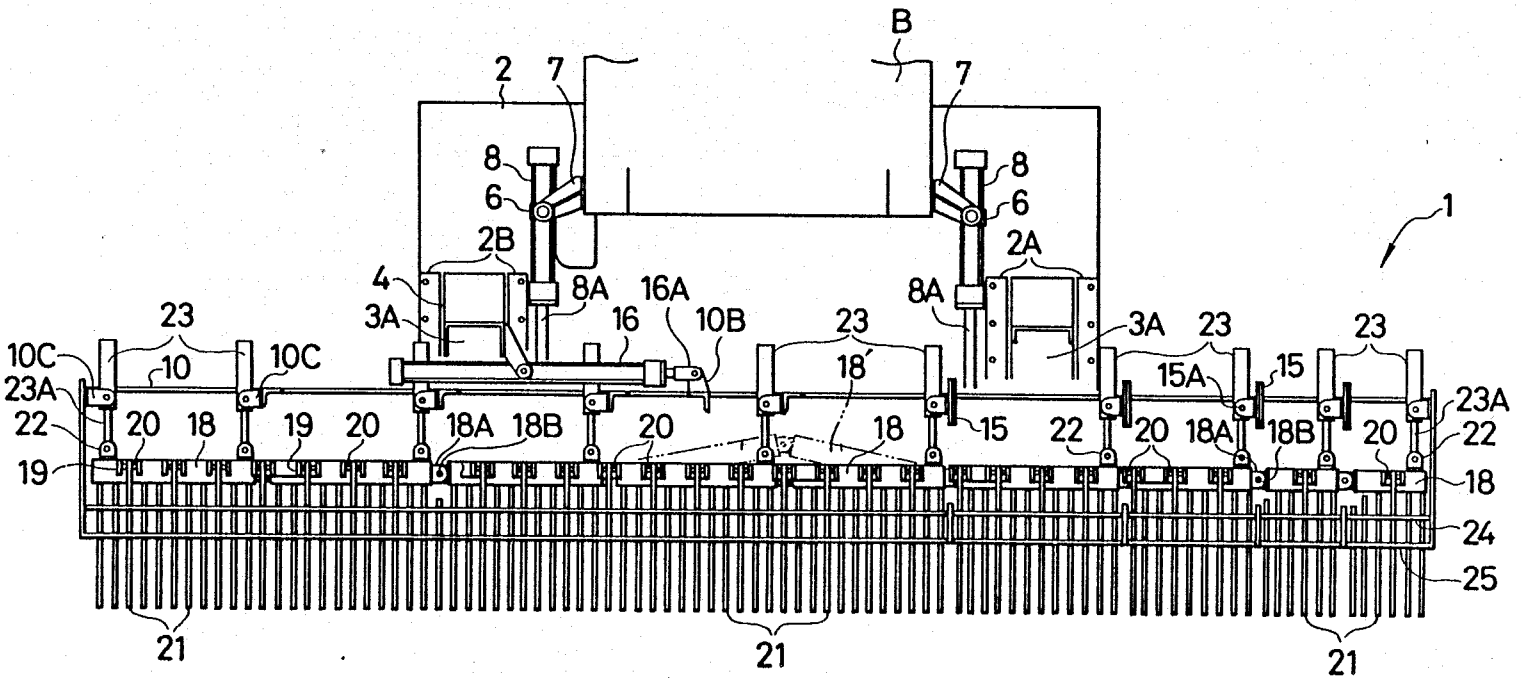
FIG. 1 of which is a rear view of the scarifier.
Figure 2:
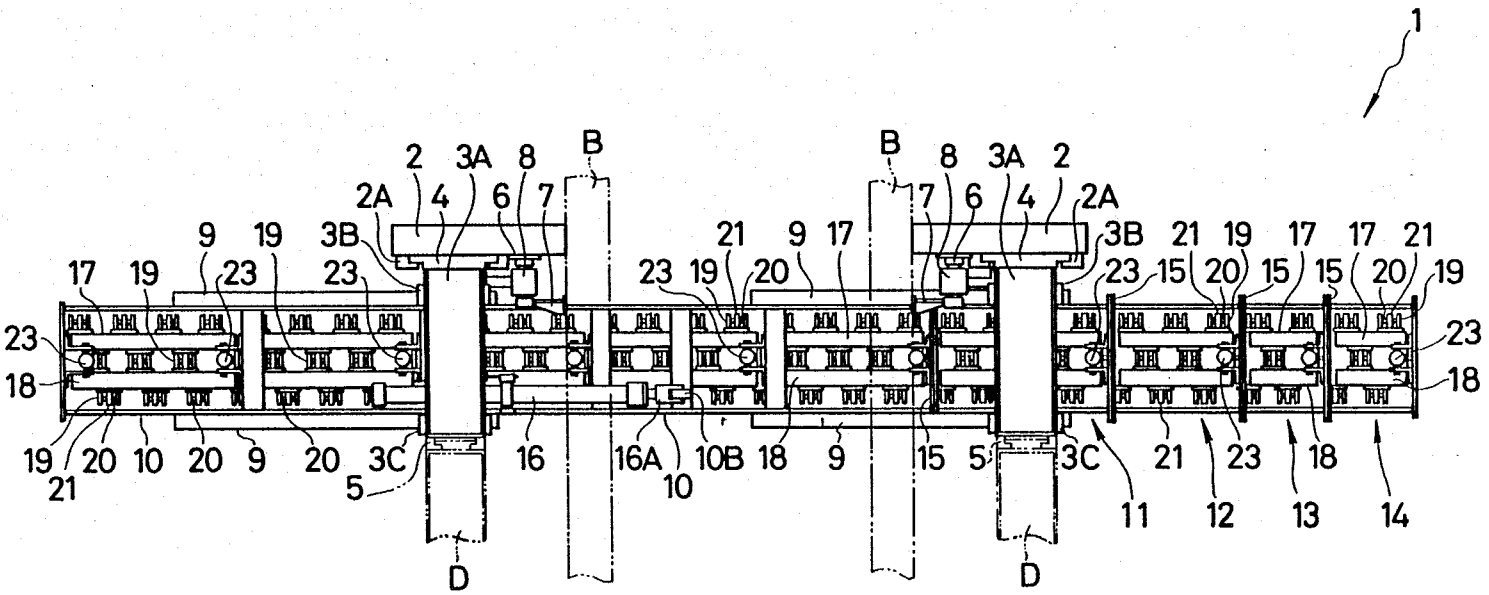
FIG. 2 of which is a plan view thereof.
Figure 3:
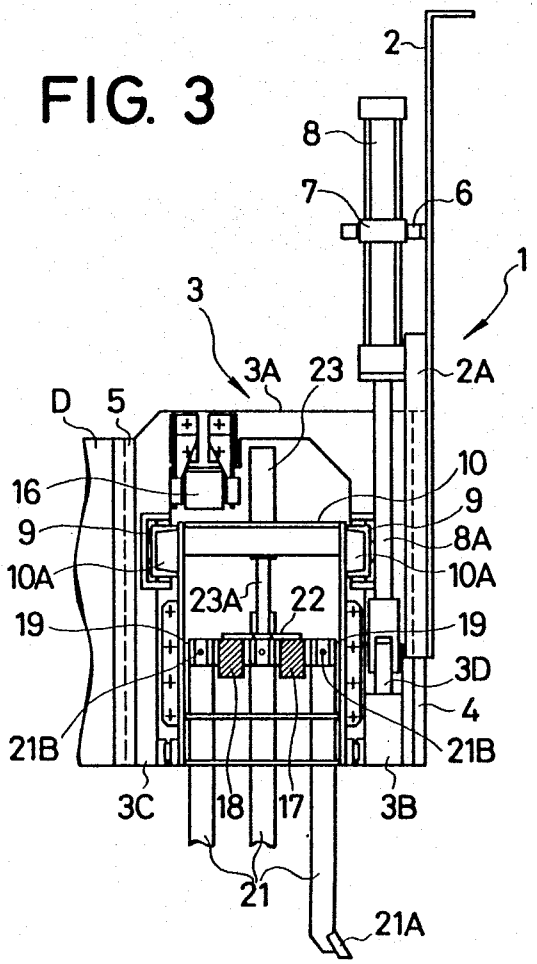
FIG. 3 of which is a side view thereof.
Figure 7:
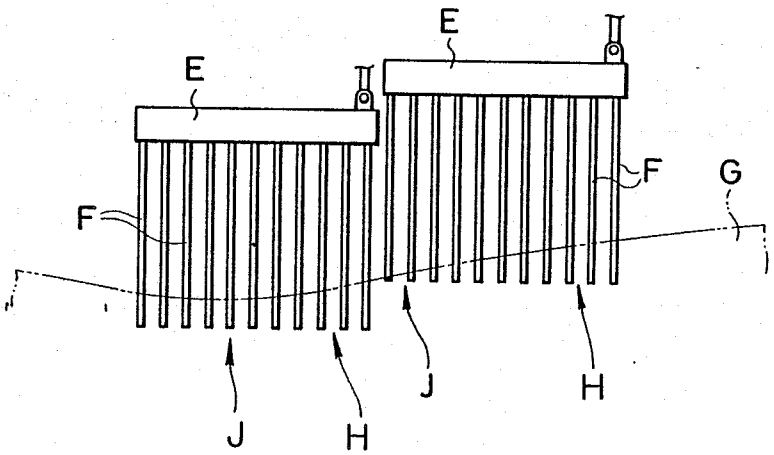
FIG. 7 (PRIOR ART)
FIG. 7 is a front view of an old scarifier, showing the manner of claws relative to supporting bars therefor.
Figure 5:
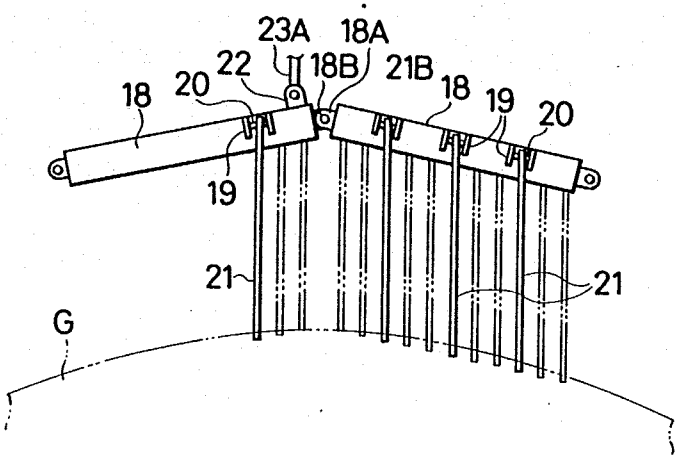
FIG. 5 of which is a front view of an essential part of the scarifier, showing the manner of the claws relative to the supporting bars.

An embodiment of the invention will now be described with reference to the drawings, in which FIG. 1 is a rear view of a scarifier; FIG. 2 is a plan view thereof; and FIG. 3 is a side view thereof.

Figure 6:
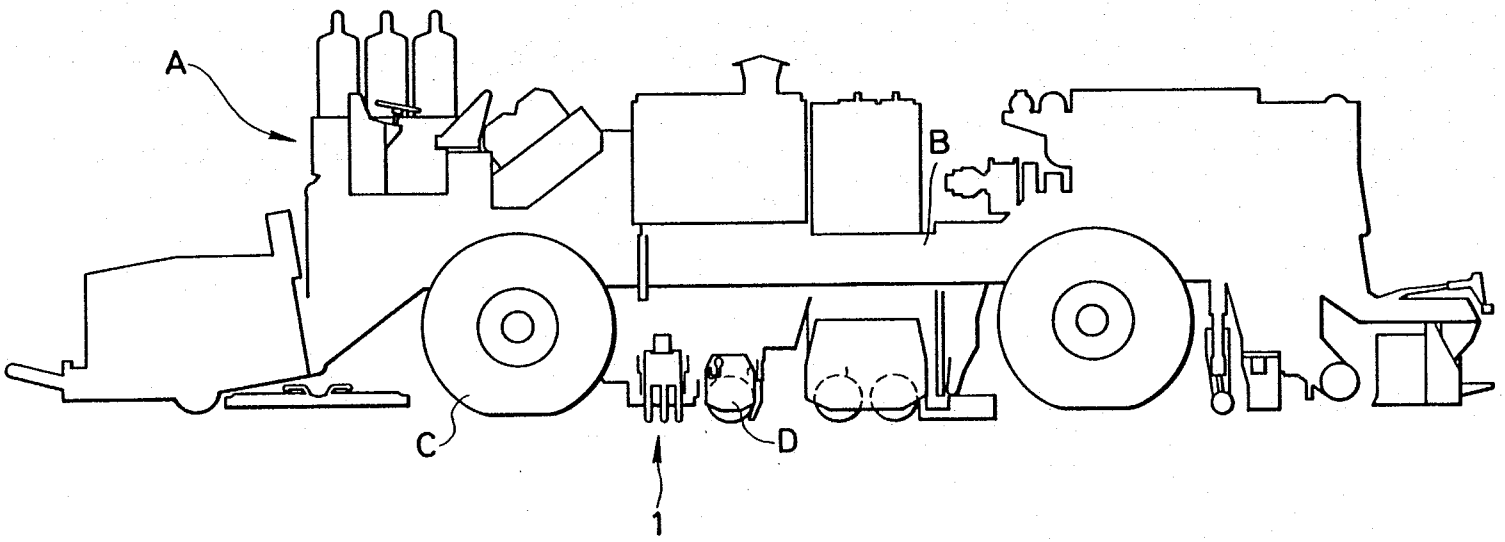

A scarifier 1 is disposed beneath a body B of a road surface layer reproducing vehicle A shown in FIG. 6 in a manner that it is located at the back of front wheels C. As shown in FIGS. 1 to 3, a mounting plate 2 is disposed beneath the vehicle body B in a manner that it is vertically erected in a direction perpendicular to the longitudinal direction of the vehicle body B. Guides 2A, 2B are provided, respectively, on the rear faces of both side edges of the mounting plate 2 in a manner that they extend in the vertical direction thereof. Into these guides 2A, 2B are vertically movably fitted the guide portions 4, 4 provided on a main frame 3, as later described, of the scarifier 1, respectively.

The main frame 3 includes a pair of upper frame members 3A, 3A which extend in the longitudinal direction of the vehicle body B and which are disposed in positions corresponding to the guides 2A, 2A, respectively, of the mounting plate 2. Beneath the longitudinal end portions of the upper frame members 3A, 3A are vertically disposed a pair of front parallel frame members 3B, 3B, respectively, as well as a pair of rear parallel frame members 3C, 3C. At the front side of the front frame members 3B, 3B, the front guide portions 4, 4 are vertically formed on the ends of the upper frame members 3A, 3A, respectively. Rear guide portions 5, 5 are also vertically formed on the rear frame members 3C, 3C, as well, which are located at the opposite sides to the sides at which the guide portions 4, 4 are located.

The front guide portions 4, 4 are fitted into the guides 2A, 2B of the mounting plate 2, respectively, for their vertical sliding movements therealong while the rear guide portions 5, 5 are vertically slidably fitted with guide portions of a mixer D, respectively.

A pair of vertically operable cylinders 8, 8 having piston rods 8A, 8A are mounted on the mounting plate 2 and also on the vehicle body B by way o supporting members (6, 7) and (6, 7), respectively, in such a manner that they are suspended from the same. Lower end portions of the piston rods 8A, 8A are connected to mounting portions 3D of the main frame 3 so that this main frame 3 may be raised or lowered by operation of the vertically operable cylinders 8, 8.

At each two opposed positions in one of which the front frame member 3B or 3B is located and in the other of which the corresponding rear frame member 3C or 3C is located in a manner to oppose the former, there are horizontally disposed guide rails 9, 9 each shaped, in cross section, like a horizontally thrown U, respectively, in such a manner that their recess portions oppose each other and that their longitudinal direction intersects the longitudinal direction of the vehicle body B at right angles thereto. Between the guide rails 9, 9 are disposed suspending frames 10, 11 12, 13 and 14 in a manner that their guide portions 10A, 10A are slidably fitted in the guide rails 9, 9, whereby the suspending frames are kept in suspension.

The suspending frames 10, 11, 12, 13 and 14 have the same construction. Among them, the main suspending frame 10 has a length in conformity with the width of the vehicle body and, when viewed from above, is laterally elongate. The remaining suspending frames 11, 12, 13 and 14 are used for being supplementarily additionally connected in sequence to the main suspending frame 10 when it is desired to scarify to a width greater than that corresponding to the length of the same 10. The reference numerals 15, 15,—denote the connecting portions between such frames. Such frame are connected to each other by fastening bolts 15A,—, or are disconnected from each other by loosening the bolts 15A,—.

On the upper frame member 3A located above the suspending frame 10 there is mounted an adjusting cylinder 16 in such a manner that it is laid horizontally while it is directed in the longitudinal direction of the suspending frame 10. The tip end of a piston rod 16A of the adjusting cylinder 6 is connected to a mounting portion 10B provided on the suspending frame 10, so that this frame 10 can be longitudinally moved along the guide rails 9, 9,—by operation of the adjusting cylinder 16. More specifically, in FIGS. 1 and 2, the cylinder 16 is kept in a state wherein its piston rod is contracted and in consequence the main suspending frame 10 is biased leftwardly of the illustrations while the other suspending frames 11, 12, 13 and 14 are connected thereto as supplementary suppending frames. As mentioned above, these supplementary suspending frames 11 to 14 are additionally connected to the main suspending frame 10 so as to permit the resultant overall frames length to be in conformity with the width of a repairing road surface. For this reason, when such supplementary frames have been removed, the adjusting cylinder 16 has its piston rod extended for equalizing those lengths of the main suspending frame by which the same protrudes outwardly from the widthwise ends of the vehicle body. Thus, the main suspending frame 10 is moved a specified distance rightwardly of each illustration.

The suspending frames 10 and 11 to 14 are in the form of a rectangular shape as viewed from above. Within each suspending frame, a pair of supporting bars 17, 18 are horizontally disposed in such a manner that both suspending bars extend in parallel in the longitudinal direction of the suspending frame, each supporting bar being located at a level which is almost equal to one half of that at which the suspending frame is located, and yet at a position intermediate between those two elemental members of the corresponding suspending frame which oppose each other in the longitudinal direction of the vehicle body. Each supporting bar 17, 18 has a specified length and is disposed so that a plurality of the supporting bars may be connected in series to each other in the longitudinal direction of the suspending frame 10. The end portion of each supporting bar 17, 18 which opposes the corresponding end portion of an adjacent supporting bar is formed with a connecting portion 18A, at which the supporting bar is separably connected to the adjacent supporting bar by means of a pin 18B.

A multiplicity of fittings 19, 19,—are disposed at prescribed intervals on both sides of each of any paired supporting bars 17, 18, each fitting 19, 19, —having a pin 20, 20, —disposed in a state wherein it is directed in the longitudinal direction of the suspending frame 10, 11 to 14, said pin 20, 20,—having a claw 21, 21,—suspended therefrom in a direction perpendicular to the road surface. When viewed from the front side, the fittings 19, 19,—which are located on both sides of each supporting bar 17, 18 are slightly spaced apart from each other so that they may be located in different positions.

Figure 4:
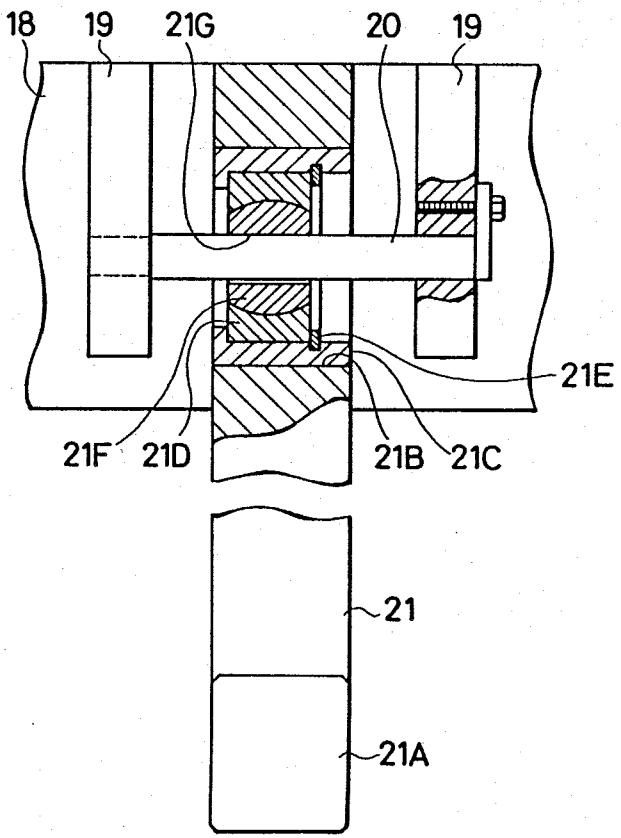
FIG. 4 of which is a front enlarged view of the of the claw.

As seen in FIG. 3 which shows its side view as well as in FIG. 4 which shows a front view of its head portion, the claw 21 is provided at its lower end with a scarifier bit 21A in the form of a projection therefrom, the head portion of said claw 21 being formed with a fitting through bore 21B laterally passing therethrough as viewed from the front side, said through bore being fitted with a bearing case 21C which is fixedly held in place. As seen, the bearing case 21C has a fitting bore into which there is fitted a bearing outer ring 21D which is fixedly held in place by a snap ring 21E. The bearing outer ring 21D is rotatably fitted with an inner race 21F having a spherical sliding contact surface, said inner race 21F having a pin hole 21G through which the said pin 20 is passed. The pin 20 is fixedly mounted on the said fitting 19, 19,—, and has the claw 21 suspended therefrom in a manner that it extends vertically downwardly, i.e., in a direction perpendicular to the road surface. The tolerance between the outer diameter of the pin 20 and the inner diameter of the pin hole 21G is set at a value great enough to permit the claw 21 to be slided and yet swung longitudinally of the pin 20.

On the end portion of each supporting bar 17, 18 there is fixedly mounted a fitting 22, 22,—, above which an adjusting cylinder 23, 23,—is mounted to the suspending frame 10 by way of a fitting 10C in such a manner that it is suspended from the latter, said adjusting cylinder 23, 23,—having its piston rod 23A,—connected at the lower end to the fitting 22, 22—. Each adjusting cylinder 23,—can be independently actuated to make its expanding/contracting operations. That is, as shown in FIG. 1, each supporting bar 18—can be maintaindd in its horizontal posture, or can be also longitudinally inclined as indicated in FIG. 1 by an imaginary line 18′ so as to be in conformity with the irregular surface of the road surface layer G. In a state wherein the supporting bar 17, 18 is kept longitudinally inclined as above, since the tolerance between the outer diameter of the pin 20, 20—of the fitting 19,—and the inner diameter of the pin hole 21G of the claw 21 is made sufficiently great, the claws 21, 21,—are kept in their vertical posture, so that their tip ends 21, 21—can follow up the irregularities of the road surface G located therebeneath. As a result, even if any concavity and convexity attributable to rutting or the like were existent on the road surface G, it is possible to perform a uniform depth of scarification in conformity with such irregularites, enabling a uniform quality of repairing reproduction to be obtained. The reference numerals 24 and 25 in FIG. 1 denote guards which have been disposed in front, and at the back, of the arrangement of the claws 21, 21,—.

As has been described above, according to the invention, the supporting bars 17, 18 from which the claws 21,—are suspended can be longitudinally vertically inclined, so that the claws can be made swingable in the longitudinal direction of the supporting bars 17, 18. This makes it possible to maintain each claw in its vertical posture even when the supporting bar 17, 18 has been inclined. This makes it possible to scarify the road surface layer G to a uniform depth even when any concavities and convexities are involved therein.

The present invention is not limited to the above-mentioned embodiment but can be worked out in various modified forms or designs. For instance, although the pin 20 in the fitting 19 has been shown and described as being parallel to the longitudinal direction of the supporting bar, the pin 20 can of course be also disposed in a manner to intersect the supporting bar 17, 18 at right angles thereto.

The invention has the following advantages.

(1) Since the supporting bars disposed within the suspending frame can be longitudinally inclined in a state wherein they are connected in series to each other and since the claws suspended from the supporting bars by way of the pins can be swung about the pins in the longitudinal direction of the supporting bars, it is possible to scarify even the road surface layer having irregularities to a uniform depth as measured from such irregular surface.

(2) Since it is simple in structure, the scarifier can be manufactured at low cost and even a conventional scarifier can be put into practical use by being partially modified.

(3) Since even the road surface layer including an irregular surface can be scarified to equal depth as measured from such irregular surface, it is possible to reproduce the road surface layer with a uniform quality.

What is claimed is:

1. A scarifier suspended beneath a body of an automotive vehicle such that it is vertically movable by means of suspending cylinders, comprising a suspending frame provided on a main frame vertically movable by means of said suspending cylinders, said suspending frame having a longitudinal axis extending in the widthwise direction of said vehicle body and being horizontally movable by means of adjusting cylinders so that it may freely slidable in the widthwise direction of said vehicle body, a plurality of supporting bars horizontally disposed within said suspending frame so that they extend in the longitudinal direction of said suspending frame and so that may two adjacent bars may be connected in series to each other by means of a connecting pin, said supporting bars being each connected to an inclining cylinder vertically provided on said suspending frame so that each bar may be inclined in a vertical plane of the longitudinal axis thereof, and a multiplicity of claws mounted, at prescribed intervals, on said supporting bars by way of pivot pins mounted parallel to said supporting bars in such a manner, that said claws extend downward from said pivot pins and that said claws are pivotal about an axis normal to a longitudinal axis of said pivot pins.

2. A scarifier according to claim 1, wherein each said claw is formed at a head portion thereof with a through bore which extends laterally as viewed from the front side of said claw, said through bore being fitted with a bearing outer ring which is rotatably fitted with an inner race, said inner race being formed with a pin hole extending laterally therethrough, said pin hole having an inner diameter larger than the outer diameter of said pivot pin.

* * * * *